US012622531B1

(12) United States Patent
Choi et al.

(10) Patent No.: US 12,622,531 B1
(45) Date of Patent: May 12, 2026

(54) INFLATABLE MATTRESS

(71) Applicant: MAYFAIR AIR, INC., Las Vegas, NV (US)

(72) Inventors: Evelyn Choi, Salt Lake City, UT (US); Christopher Lee, Salt Lake City, UT (US)

(73) Assignee: MAYFAIR AIR, INC., Las Vegas, NV (US)

( * ) Notice: Subject to any disclaimer, the term of this patent is extended or adjusted under 35 U.S.C. 154(b) by 316 days.

(21) Appl. No.: 18/451,042

(22) Filed: Aug. 16, 2023

Related U.S. Application Data

(60) Provisional application No. 63/352,896, filed on Jun. 16, 2022.

(51) Int. Cl.
*A47C 27/08* (2006.01)

(52) U.S. Cl.
CPC ..... *A47C 27/081* (2013.01)

(58) Field of Classification Search
CPC .... A47C 27/081; A47C 27/082; A47C 27/087
USPC ..... 5/706, 710, 711
See application file for complete search history.

(56) References Cited

U.S. PATENT DOCUMENTS 1,382,531 A * 6/1921 Newborn ..... A47C 27/081 5/733
1,610,898 A * 12/1926 Steiner ..... A47C 27/081 5/712
2,318,492 A * 5/1943 Johnson ..... A47C 27/087 5/712
4,541,135 A * 9/1985 Karpov ..... A47C 27/087 5/710
6,671,910 B2 * 1/2004 Hsu ..... A47C 27/087 5/710
7,322,064 B2 * 1/2008 Wu ..... A47C 27/10 5/711
7,337,485 B2 * 3/2008 Metzger ..... A47C 27/087 5/711
7,353,555 B2 * 4/2008 Lau ..... A47C 27/081 5/711
7,478,448 B2 * 1/2009 Boso ..... A47C 27/087 5/713
8,656,540 B2 * 2/2014 Chen ..... A47C 27/081 5/710
11,528,998 B2 * 12/2022 Miller, Jr. ..... A47C 27/083
11,583,099 B2 * 2/2023 Li ..... A47C 27/10
11,641,948 B2 * 5/2023 Huang ..... A47C 27/087 5/706
11,696,648 B2 * 7/2023 Huang ..... A47C 27/087 5/710
12,053,097 B1 * 8/2024 Luo ..... A47C 27/082
2005/0223495 A1 * 10/2005 Wu ..... A47C 27/10 5/710
2006/0265810 A1 * 11/2006 Wu ..... A47C 27/081 5/712

(Continued)

*Primary Examiner* — David R Hare
(74) *Attorney, Agent, or Firm* — Perkins Coie LLP

(57) ABSTRACT

An inflatable mattress comprises a top panel, a bottom panel, and a plurality of side panels. The mattress has a hollow cavity configured to be inflated. The mattress includes a top support device associated with only three sides of the inflatable mattress. The mattress includes a pillow support having a first edge and a second edge. The first edge is coupled to the top panel and the second edge is associated with the bottom panel.

20 Claims, 6 Drawing Sheets

(56) References Cited

U.S. PATENT DOCUMENTS

| | | | | |
|---|---|---|---|---|
| 2007/0124864 | A1* | 6/2007 | Lau | A47C 27/081 5/711 |
| 2007/0169274 | A1* | 7/2007 | Boso | A47C 27/081 5/706 |
| 2009/0165211 | A1* | 7/2009 | Song | A47C 27/081 5/706 |
| 2013/0180052 | A1* | 7/2013 | Chen | A47C 27/082 5/711 |
| 2015/0113736 | A1* | 4/2015 | Cox | A47C 27/087 5/655.3 |
| 2018/0027985 | A1* | 2/2018 | Ocegueda Gallaga | A47C 27/087 |
| 2021/0127849 | A1* | 5/2021 | Li | A47C 27/10 |
| 2021/0169232 | A1* | 6/2021 | Hou | A47C 27/087 |

* cited by examiner

INFLATABLE MATTRESS

CROSS REFERENCE TO RELATED APPLICATIONS

The application claims priority to U.S. Provisional Patent Application Ser. No. 63/352,896, titled "Inflatable Mattress," and filed Jun. 16, 2022. The disclosure of this application is incorporated by reference herein in its entirety.

FIELD OF THE DISCLOSURE

The disclosure relates generally to the field of mattresses. More specifically, the disclosure relates to the field of inflatable mattresses.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an aspect, an inflatable mattress comprises a top panel, a bottom panel, and a plurality of side panels. The mattress has a hollow cavity configured to be inflated. The mattress includes a top support device associated with only three sides of the inflatable mattress. The mattress includes a pillow support having a first edge and a second edge. The first edge is coupled to the top panel and the second edge is associated with the bottom panel.

In some aspects, the techniques described herein relate to an inflatable mattress, further including a pillow support beam associated with the pillow support.

In some aspects, the techniques described herein relate to an inflatable mattress, wherein the pillow support beam is coupled to the pillow support and to at least one of the plurality of side panels.

In some aspects, the techniques described herein relate to an inflatable mattress, wherein the pillow support extends within the hollow cavity at an angle.

In some aspects, the techniques described herein relate to an inflatable mattress, wherein the first edge is inboard the second edge.

In some aspects, the techniques described herein relate to an inflatable mattress, wherein the top support device circumscribes at least one side of the inflatable mattress.

In some aspects, the techniques described herein relate to an inflatable mattress, further including a bottom support device.

In some aspects, the techniques described herein relate to an inflatable mattress, wherein the top support device is coupled at least the top panel and the bottom support device is coupled at least to the bottom panel.

In some aspects, the techniques described herein relate to an inflatable mattress, wherein each of the top support device and the bottom support device are coupled to at least one of the plurality of side panels.

In some aspects, the techniques described herein relate to an inflatable mattress, wherein the bottom support device includes two support devices with a space therebetween.

In some aspects, the techniques described herein relate to an inflatable mattress, wherein the first edge is curved to simulate a plurality of pillows.

In some aspects, the techniques described herein relate to an inflatable mattress, further including a plurality of supportive coils.

In some aspects, the techniques described herein relate to an inflatable mattress, wherein at least some of said plurality of supportive coils are oblong.

In some aspects, the techniques described herein relate to an inflatable mattress, wherein at least some of said plurality of supportive coils are cylindrical.

In some aspects, the techniques described herein relate to an inflatable mattress, including: a top panel, a bottom panel, and a plurality of side panels coupled to the top panel and said side panel. The mattress includes a hollow cavity configured to be inflated. The mattress includes a top support device associated with only some of the side panels. The mattress includes a pillow support extending within the hollow cavity and having a first edge and a second edge. The first edge is coupled to the top panel and the second edge is associated with the bottom panel.

In some aspects, the techniques described herein relate to an inflatable mattress, wherein the pillow support extends within the hollow cavity at an angle.

In some aspects, the techniques described herein relate to an inflatable mattress, wherein the first edge is arcuate.

In some aspects, the techniques described herein relate to an air mattress, including: a top panel, a bottom panel, and a plurality of side panels coupled to said top panel and said side panel. The mattress includes a hollow cavity configured to be inflated. The mattress has a top support device associated with only some of the side panels and a bottom support device associated with only some of the side panels. The mattress has a pillow support extending within the hollow cavity and having a first edge and a second edge. The first edge is coupled to the top panel. The second edge is associated with the bottom panel.

In some aspects, the techniques described herein relate to an air mattress, wherein the pillow support has associated therewith a first beam and a second beam.

In some aspects, the techniques described herein relate to an air mattress, wherein each of the first beam and the second beam are coupled to the pillow support and to one of the plurality of side panels. These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

Illustrative embodiments of the present disclosure are described in detail below with reference to the attached drawing figures and wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or limit the disclosure to the precise forms disclosed.

In the following description, specific details are set forth to provide a thorough understanding of exemplary embodiments of the present disclosure. However, it will be apparent to one skilled in the art that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

An air mattress, also known as an airbed, inflatable mattress, or a blow-up bed, is an inflatable mattress which may comprise polyvinyl chloride (PVC) or textile-reinforced urethane plastic or rubber, among other materials and fabrics. Air mattresses are incredibly portable as a deflated mattress can be compacted and carried or stored in a small form. Typically, air mattresses are inflated by blowing into a valve, either with a manual or an electric pump. Some are automatically inflated when a valve is opened, up to a certain pressure with additional inflation manually or by pump.

Air mattresses are popular for their compact storage and multiple uses such as camping, temporary or full-time home use. Some air mattresses may be optimized to combine several uses (e.g., camping and guest use) while others are single purpose. Most air mattresses tend to mimic the appearance and comfort of a traditional mattress.

Figure 1:
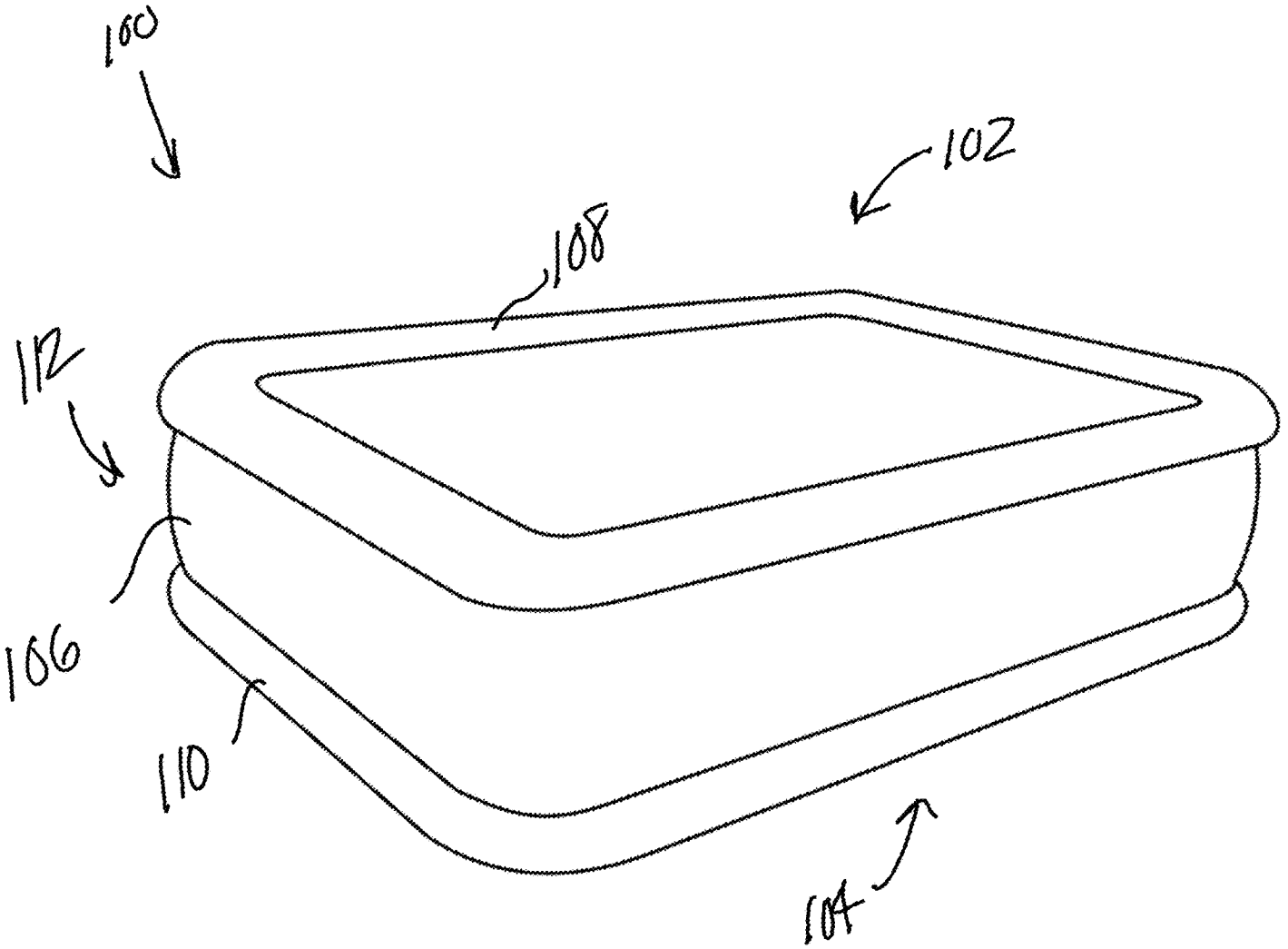
FIG. 1 is a perspective view of an air mattress in accordance with an example embodiment.

FIG. 1 illustrates an air mattress 100 with a top panel 102 and a bottom panel 104 positioned opposite the top panel 102. The air mattress 100 may include one or more side panels 106. For example, each side of the air mattress 100 may include a different panel 106 with a seam at a corner (e.g., corner 112). In some embodiments, the mattress 100 may have one or more bumpers 108, 110. In some embodiments, the mattress 100 may only have a top-side bumper 108. In further embodiments, the mattress 100 may have a bottom bumper 110. In some instances, the bumpers 108, 110 may be symmetrical. In other embodiments, the bumpers 108, 110 may be asymmetrical.

The air mattress 100 may include any size of mattress include twin, full, queen, king, twin XL, California king, and the like. The mattress 100 may also be sized for specific uses such as in a vehicle, bed of a pick-up truck, tent, and the like. The air mattress 100 may also vary in height. For example, in some embodiments, the air mattress 100 may be as slim as approximately six (6) inches or as thick as twenty-four (24) inches. These depths are meant to be illustrative and not independently limiting.

Figure 2A:
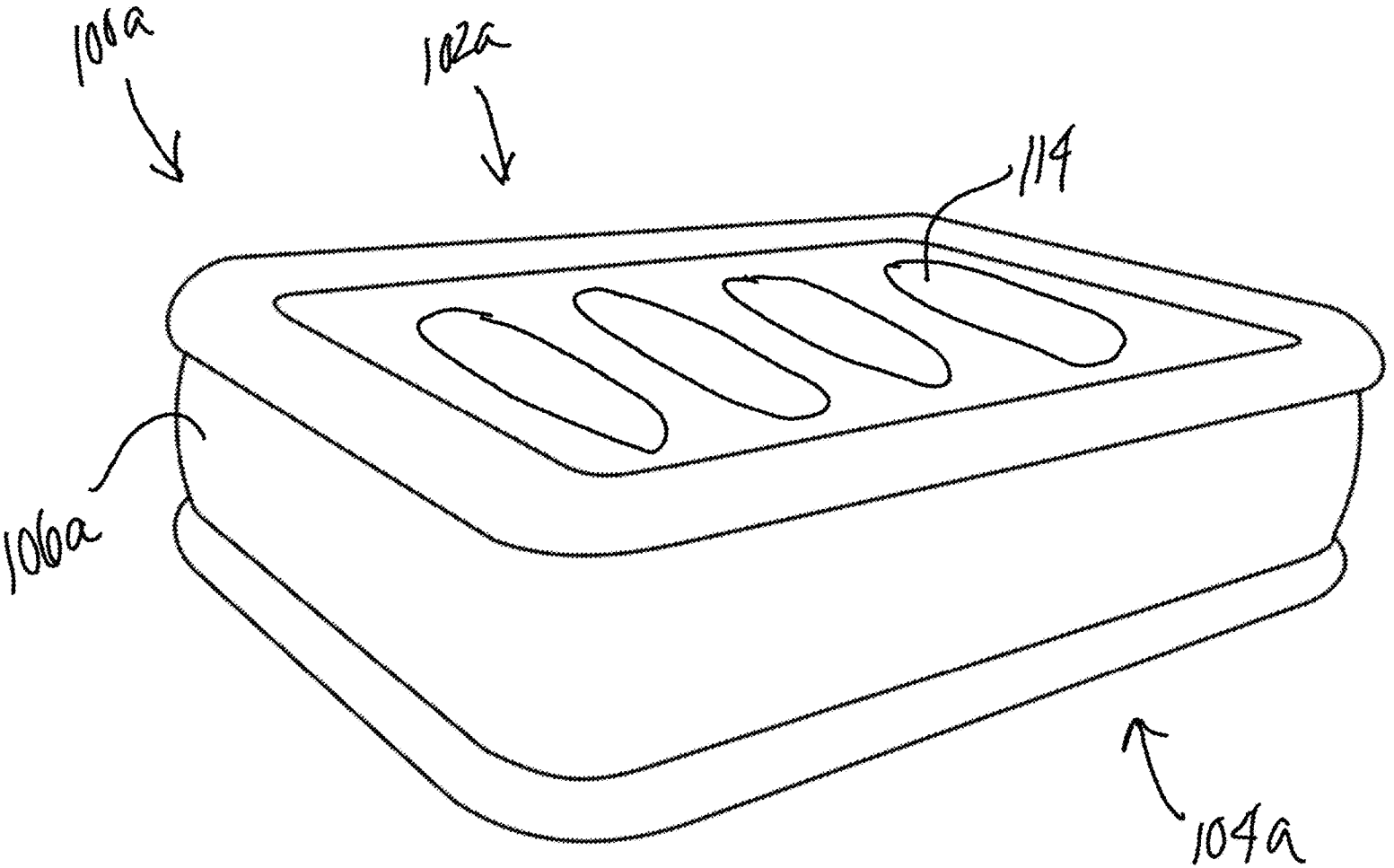
FIG. 2A is a perspective view of an air mattress in accordance with another example embodiment.
Figure 2B:
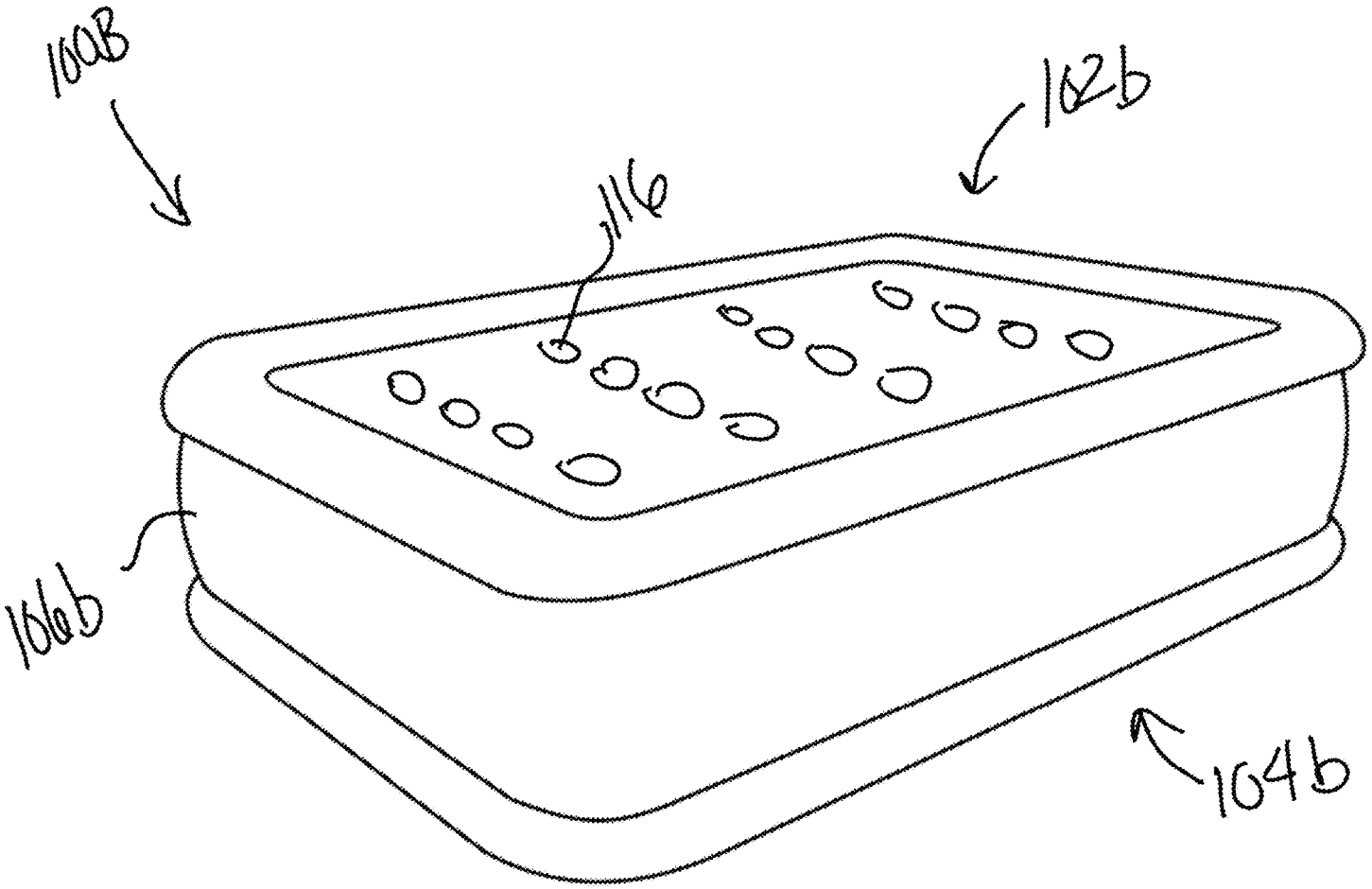
FIG. 2B is a perspective view of an air mattress in accordance with another example embodiment.
Figure 2C:
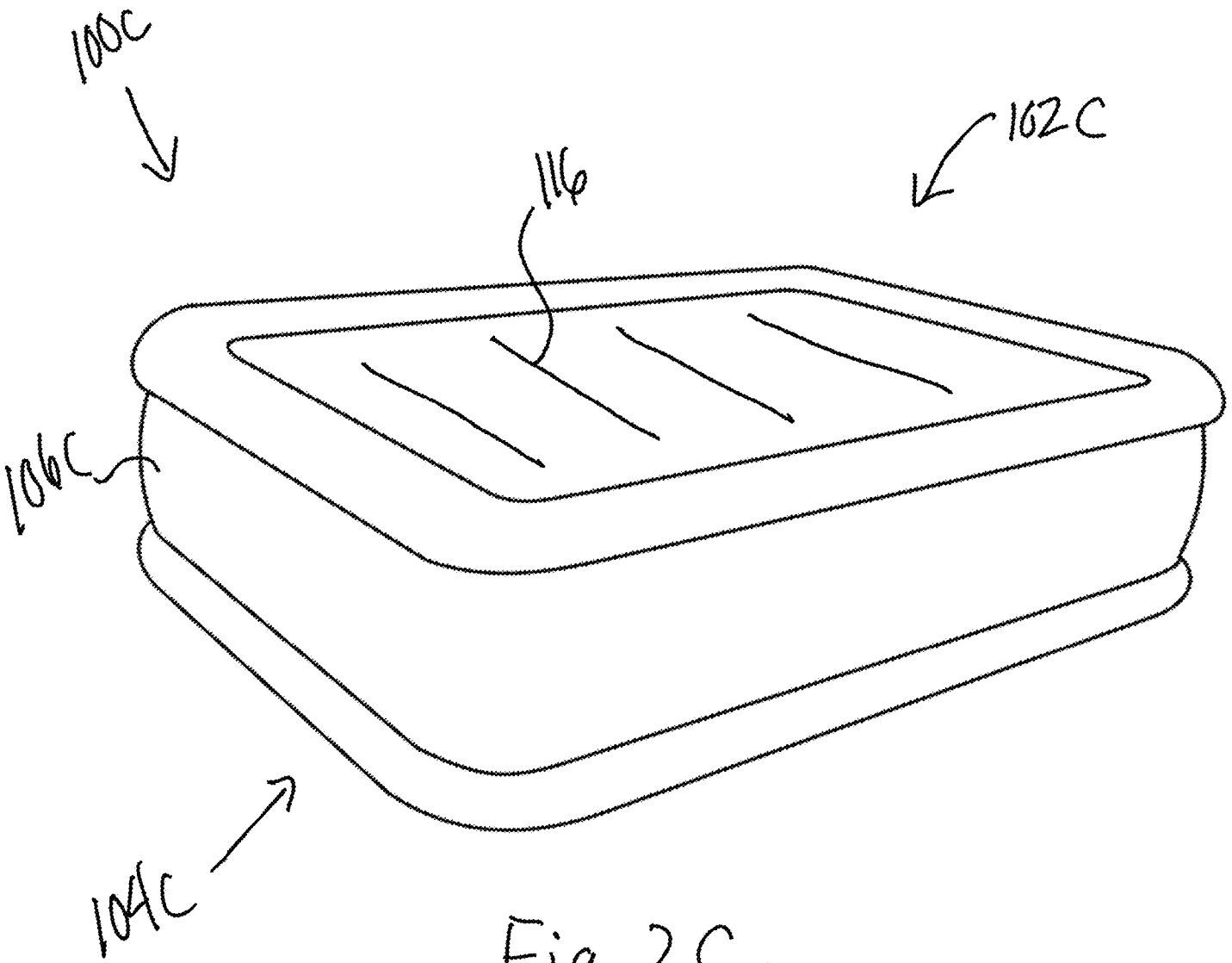
FIG. 2C is a perspective view of an air mattress in accordance with another example embodiment.

FIGS. 2A, 2B, and 2C respectively depict mattresses 100*a*, 100*b*, and 100*c*. The mattresses 100*a*, 100*b*, and 100*c* have disparate appearances. The differences in the appearance of the mattresses 100*a*, 100*b*, and 100*c* may be due to the interior structure of these air mattresses. For example, the interior structure of the air mattress 100 reflects the outward appearance of the air mattress.

As shown in FIG. 2A, the mattress 100*a* has oblong shaped features 114 on a top surface 102*a* of the mattress 100*a*. The mattress 100*a* may also have symmetrical oblong shaped features 114 on a bottom side or panel 104*a* of the mattress. The oblong-shaped features 114 may be a result of coils in the internal structure of the air mattress. The internal coils or pieces of material may connect the top panel 102*a* of the mattress 100*a* with the bottom panel 104*a* of the mattress and may enable the mattress 100*a* to maintain a substantially rectangular shape. The coils may also be vertical pulling bands or other structures that couples one side of the mattress to another opposing side.

FIG. 2B displays another variation of a top panel 102*b* design of an air mattress 100*b*. In this variation, the mattress 100*b* may have any number of circles 116 as coils or connectors. The circles 116 may be spaced between the top panel 102*b* and bottom panel 102*c* of the mattress 100*b*. The circles 116 may appear in organized rows as shown in FIG. 2B, or they may be in a different pattern or no pattern at all.

FIG. 2C shows another variation of a mattress 100*b* with a series of lines or rows 116. The lines or rows 116 are another variation of vertical pulling bands to allow the mattress 100*c* to maintain its shape.

Figures 3, 4A, 4B:
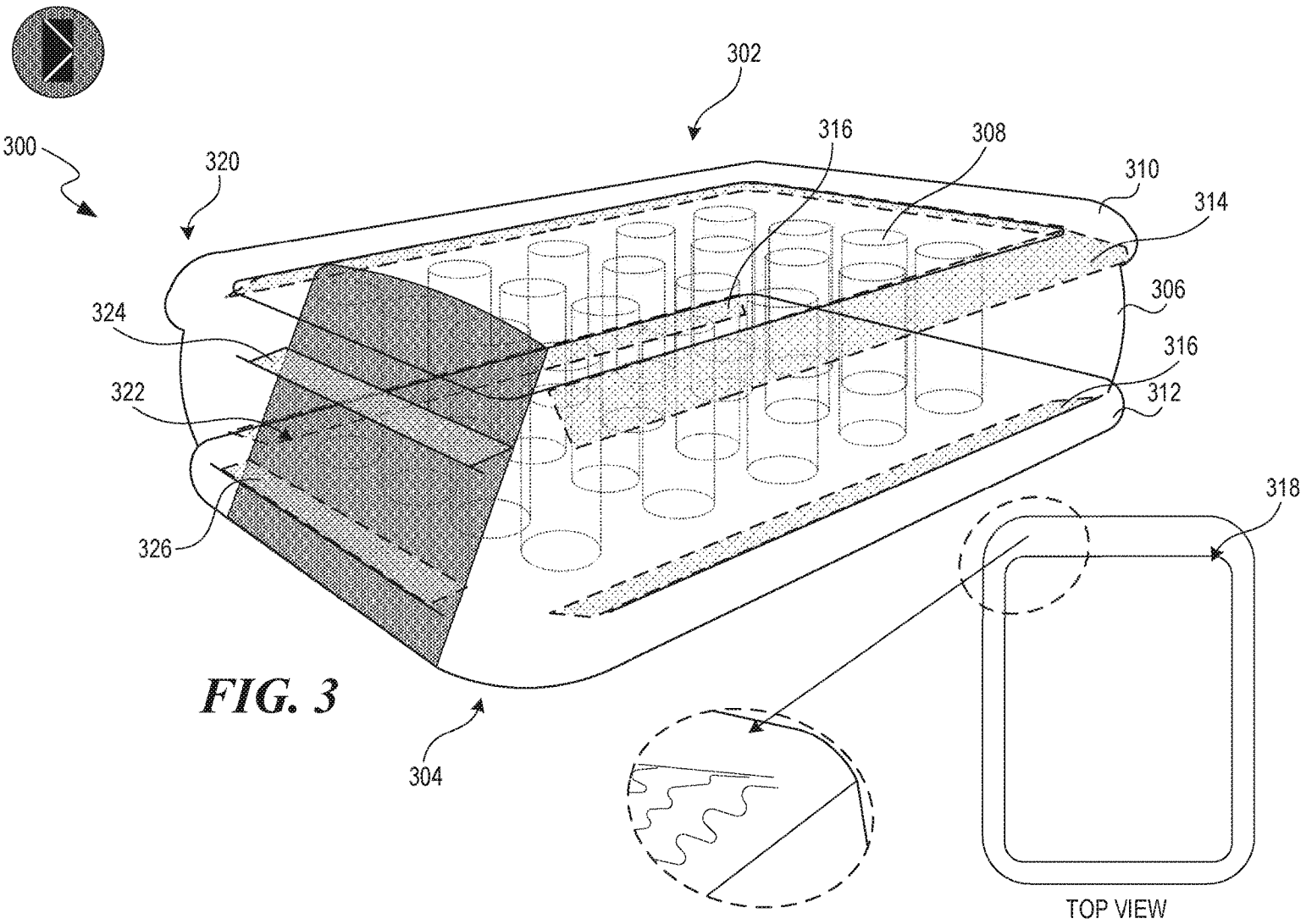
FIG. 3 is a schematic view of an air mattress in accordance with an example embodiment.
FIG. 4A is a top-down view of an air mattress in accordance with an example embodiment.
FIG. 4B is a close-up view of the air mattress shown in FIG. 4A in accordance with an example embodiment.

FIG. 3 shows an air mattress 300 with an internal structure to create a bumper feature 310 on the upper side and a corresponding bumper feature 312 on the lower side. The air mattress 300 may be any of the air mattresses discussed with references to FIGS. 1 and 2A-2C. In aspects, the mattress 300 may only have one of the bumper feature 310 and 312.

The air mattress 300 may include a top side 302, a bottom side 304 opposite the top side 302 and one or more side panels 306 or peripheral panels connecting the top side 302 to the bottom side 304. As discussed previously, one or more coil features 308 may also couple the top panel 302 to the bottom panel 304. In this embodiment, the coil feature 308 is a symmetrical display of circular coils, but as discussed, the coil feature may take any pattern, shape, or form. The coils 308 may give the mattress 300 the appearance of a pillow top mattress.

The bumper features 310 and 312 may be located, in embodiments, entirely or partially within the hollow cavity of the mattress 300. As is known, the hollow cavity of the mattress 300 may be inflated with fluid (e.g., air) using any suitable means, e.g., a pump may be used to pump air into the hollow cavity via an opening that may be selectively closable. Air may likewise be pumped out or simply let out of the mattress 300 via one or more openings to deflate the mattress.

In the embodiment shown, the top bumper 310 may include a first support beam (or support structure or device) 314 which may extend between the top panel 302 and the side panel 306. For example, the first support beam 314 may be sewn via a seam to the top panel 302 and the side panel 306. In embodiments, the support beam 314 may wrap around three sides of the mattress, including two of the longer sides. This may give a pillow-top appearance as shown in FIG. 4A. In other embodiments, two support beams may be provided (e.g., one on each of the longer sides of the mattress, or one on each of the shorter sides of the mattress).

Figure 8:
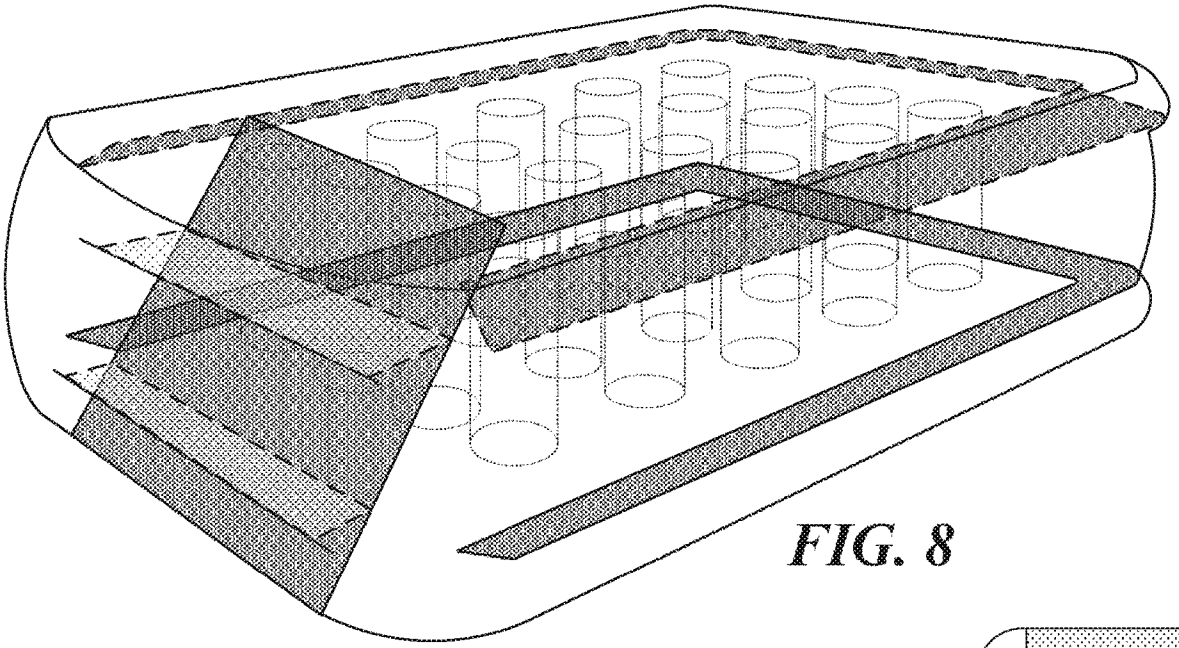
FIG. 8 is a schematic view of an air mattress in accordance with an example embodiment.

A bottom bumper 312 may have a complementary beam (or structure or device) 316 which may mimic the top beam 314 as shown in FIG. 8. In some embodiments, the beam 316 of the bottom bumper 312 may extend along three sides of the mattress, or along two sides (e.g., the smaller sides or the longer sides of the mattress). For example, such as the embodiment shown in FIG. 3, the lower beam 316 may not wrap around a substantial portion of a lower circumference of the mattress 300 and may instead include two discrete panels on opposing sides of the mattress 300 as shown. The upper beam 314 may be likewise constructed, or may differ from the lower beam 316. The lower beam, in embodiments, may be coupled via a seam to one or more side panels 306 and the bottom side 304.

The support beam 314 and the support beam 316 may, in embodiments, be inflatable. For example, the support beams 314 and/or 316 may be in fluid communication with the hollow internal cavity. In some embodiments, the support beams 314 and/or 316 may have associated therewith respective openings and these beams 314 and/or 316 may be inflated separate from the hollow internal cavity. In some embodiments, the support beams 314 and/or 316 may not be configured to be inflatable.

The mattress 300 may include a pillow-like feature 318 (FIG. 4A) at a head 320 of the mattress 300. The pillow-like feature 318 may include a pillow-support beam 322 and at least one horizontal support beam 324. In some embodiments, at least one additional support beam 326 may be included.

Figure 7:
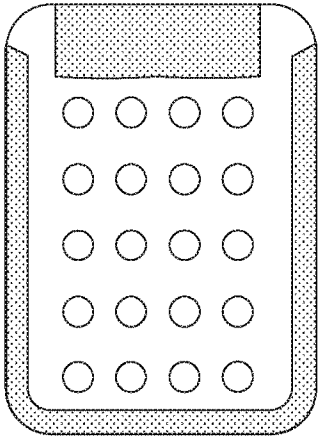
FIG. 7 is an alternative top-down view of the air mattress shown in FIG. 3 in accordance with an example embodiment.
Figure 6:
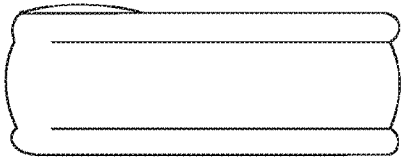
FIG. 6 is another schematic side view of the air mattress shown in FIG. 3 in accordance with an example embodiment.
Figure 5:
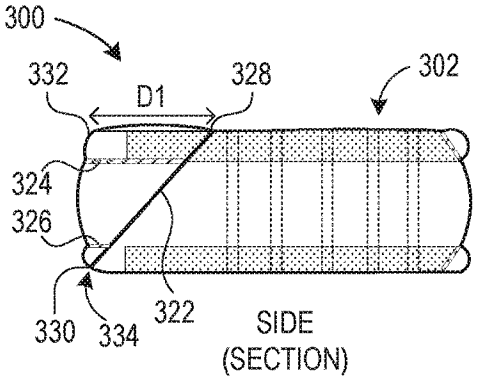
FIG. 5 is a schematic side view of the air mattress shown in FIG. 3 in accordance with an example embodiment.

As shown in FIG. 5, the pillows-support 322 beam may have a first edge 328 and a second edge 330 opposite the first edge 328. The first edge 328 of the beam 322 may couple to the top panel 302 of the mattress 300 at a distance D1 from a top corner 332 of the mattress. The distance D1 may be a similar distance to standard pillows. This may cause the mattress to have a feature that mimics the feel of a pillow as shown in FIG. 7.

The second edge 330 may couple to the mattress 300 at a bottom corner 334 of the mattress 300. This may provide stability to the mattress shape and allow the bowing of the pillow-like feature. In further embodiments, the bottom edge 330 may couple to the bottom panel 304 of the mattress. In still further embodiments, the bottom edge 330 may couple to a side panel 306 as a lower portion of the side panel 306. In some embodiments, the second edge 330 may couple to the bottom panel 304 of the mattress. As can be seen, the pillows-support (also referred to herein as a pillow support) may extend within the hollow cavity at an angle.

In some embodiments, the beam 322 may include one or more support beams 324, 326. The support beams 324, 326 may couple the pillow beam 322 to a side panel 306 of the mattress 300. This may prevent the panel 306 proximate the headboard from bowing and enable mattress shape integrity.

In some embodiments, the top edge 338 of the mattress may not be linear. For example, the top edge 338 of the mattress may have a slightly double curvature to mimic the look and feel of two pillows. The overall contour of the edge 328 may depend upon a size of the mattress 300. In embodiments, the edge 328 may be arcuate.

A person skilled in the art will be able to practice the present invention after careful review of this description, which is to be taken as a whole. Details have been included to provide a thorough understanding. In other instances, well-known aspects have not been described in order to prevent unnecessarily obscure this description.

Some technologies or techniques described in this document may be known. Even then, however, it is not known to apply such technologies or techniques as described in this document or for the purposes described in this document.

This description includes one or more examples, but this fact does not limit how the disclosure may be practiced. Indeed, examples, instances, versions, or embodiments of the disclosure may be practiced according to what is described, or yet differently, and also in conjunction with other present or future technologies. Other such embodiments include combinations and sub-combinations of features described herein, including, for example, embodiments that are equivalent to the following: providing or applying a feature in a different order than in a described embodiment; extracting an individual feature from one embodiment and inserting such feature into another embodiment; removing one or more features from an embodiment, or both removing a feature from an embodiment and adding a feature extracted from another embodiment while providing the features incorporated in such combinations and sub-combinations.

In general, the present disclosure reflects preferred embodiments of the invention. The attentive reader will note, however, that some aspects of the disclosed embodiments extend beyond the scope of the claims. To the respect that the disclosed embodiments indeed extend beyond the scope of the claims, the disclosed embodiments are to be considered supplementary background information and do not constitute definitions of the claimed invention.

In this document, the phrases "constructed to," "adapted to," and/or "configured to" denote one or more actual states of construction, adaptation, and/or configuration that is fundamentally tied to physical characteristics of the element or feature preceding these phrases and, as such, reach well beyond merely describing an intended use. Any such elements or features can be implemented in a number of ways, as will be apparent to a person skilled in the art after reviewing the present disclosure, beyond any examples shown in this document.

Incorporation by reference: References and citations to other documents, such as patents, patent applications, patent publications, journals, books, papers, web contents, have been made throughout this disclosure. All such documents are hereby incorporated herein by reference in their entirety for all purposes.

Reference numerals: In this description, a single reference numeral may be used consistently to denote a single item, aspect, component, or process. Moreover, a further effort may have been made in the preparation of this description to use similar though not identical reference numerals to denote other versions or embodiments of an item, aspect, component, or process that are identical or at least similar or related. Where made, such a further effort was not required but was nevertheless made gratuitously so as to accelerate comprehension by the reader. Even where made in this document, such a further effort might not have been made completely consistently for all of the versions or embodiments that are made possible by this description. Accordingly, the description controls defining an item, aspect, component, or process rather than its reference numeral. Any similarity in reference numerals may be used to infer a similarity in the text, but not to confuse aspects where the text or other context indicates otherwise.

The claims of this document define certain combinations and sub combinations of elements, features, and acts or operations, which are regarded as novel and non-obvious. The claims also include elements, features, and acts or operations that are equivalent to what is explicitly mentioned. Additional claims for other such combinations and sub combinations may be presented in this or a related document. These claims are intended to encompass within their scope all changes and modifications that are within the true spirit and scope of the subject matter described herein. The terms used herein, including in the claims, are generally intended as "open" terms. For example, the term "including" should be interpreted as "including but not limited to," the term "having" should be interpreted as "having at least," etc. If a specific number is ascribed to a claim recitation, this number is a minimum but not a maximum unless stated otherwise. For example, where a claim recites "a" component or "an" item, it means that the claim can have one or more of this component or this item.

In construing the claims of this document, the inventor(s) invoke 35 U.S.C. § 112(f) only when the words "means for" or "steps for" are expressly used in the claims. Accordingly, if these words are not used in a claim, then that claim is not intended to be construed by the inventor(s) in accordance with 35 U.S.C. § 112(f).

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The invention claimed is:

1. An inflatable mattress, comprising:

a top panel, a bottom panel, and a plurality of side panels;

a hollow cavity, said hollow cavity configured to be inflated;

a top support device associated with only three sides of the inflatable mattress;

a pillow support having a first edge and a second edge, the first edge coupled to the top panel, the second edge coupled to the bottom panel; and a pillow support beam associated with the pillow support, said pillow support beam coupled to an inclined surface of the pillow support, the inclined surface extending between the first edge and the second edge.

2. The inflatable mattress of claim 1, further comprising an additional pillow support beam associated with the pillow support.

3. The inflatable mattress of claim 2, wherein the pillow support beam and the additional pillow support beam are each coupled to the pillow support and to at least one of the plurality of side panels.

4. The inflatable mattress of claim 1, wherein the pillow support extends within the hollow cavity at an angle.

5. The inflatable mattress of claim 1, wherein the first edge is inboard the second edge.

6. The inflatable mattress of claim 1, wherein the top support device circumscribes at least one side of the inflatable mattress.

7. The inflatable mattress of claim 1, further comprising a bottom support device.

8. The inflatable mattress of claim 7, wherein the top support device is coupled at least the top panel and the bottom support device is coupled at least to the bottom panel.

9. The inflatable mattress of claim 8, wherein each of the top support device and the bottom support device are coupled to at least one of the plurality of side panels.

10. The inflatable mattress of claim 8, wherein the bottom support device includes two support devices with a space therebetween.

11. The inflatable mattress of claim 1, wherein the first edge is curved to simulate a plurality of pillows.

12. The inflatable mattress of claim 1, further comprising a plurality of supportive coils.

13. The inflatable mattress of claim 12, wherein at least some of said plurality of supportive coils are oblong.

14. The inflatable mattress of claim 12, wherein at least some of said plurality of supportive coils are cylindrical.

15. An inflatable mattress, comprising:

a top panel, a bottom panel, and a plurality of side panels coupled to said top panel and said side panel;

a hollow cavity, said hollow cavity configured to be inflated;

a top support device associated with only some of the side panels;

a pillow support extending within the hollow cavity and having a first edge and a second edge, the first edge coupled to the top panel, the second edge coupled to the bottom panel; and a pillow support beam associated with the pillow support, said pillow support beam coupled to an inclined surface of the pillow support, the inclined surface extending between the first edge and the second edge.

16. The inflatable mattress of claim 15, wherein the pillow support extends within the hollow cavity at an angle.

17. The inflatable mattress of claim 15, wherein the first edge is arcuate.

18. An air mattress, comprising:

a top panel, a bottom panel, and a plurality of side panels coupled to said top panel and said side panel;

a hollow cavity configured to be inflated;

a top support device associated with only some of the side panels;

a bottom support device associated with only some of the side panels;

a pillow support extending within the hollow cavity and having a first edge and a second edge, the first edge coupled to the top panel, the second edge coupled to the bottom panel; and a pillow support beam associated with the pillow support, said pillow support beam coupled to an inclined surface of the pillow support, the inclined surface extending between the first edge and the second edge.

19. The air mattress of claim 18, wherein the pillow support has associated therewith an additional pillow support beam.

20. The air mattress of claim 19, wherein each of the pillow support beam and the additional pillow support beam are coupled to the pillow support and to one of the plurality of side panels.

* * * * *